US007222890B2

(12) United States Patent
Yuan

(10) Patent No.: US 7,222,890 B2
(45) Date of Patent: May 29, 2007

(54) MULTIPLE BACKSET LATCH

(76) Inventor: Zhi Man Yuan, Min Le Village, Si Quig Rd, No. 2, Haizhou, 2 Hongshan Province (CN)

( * ) Notice: Subject to any disclaimer, the term of this patent is extended or adjusted under 35 U.S.C. 154(b) by 128 days.

(21) Appl. No.: 11/038,993

(22) Filed: Jan. 20, 2005

(65) Prior Publication Data

US 2006/0006659 A1 Jan. 12, 2006

Related U.S. Application Data

(60) Provisional application No. 60/580,550, filed on Jun. 17, 2004.

(51) Int. Cl.
*E05C 1/00* (2006.01)

(52) U.S. Cl. ..... 292/1.5; 292/DIG. 60

(58) Field of Classification Search ..... 292/1.5, 292/337, DIG. 60
See application file for complete search history.

(56) References Cited

U.S. PATENT DOCUMENTS 5,743,573 A * 4/1998 Huang ..... 292/1.5
6,186,562 B1 * 2/2001 Huang ..... 292/169
6,334,635 B1 * 1/2002 Huang ..... 292/1.5
6,688,660 B2 * 2/2004 Huang ..... 292/337
6,736,432 B2 * 5/2004 Huang et al. ..... 292/1.5

* cited by examiner

*Primary Examiner*—Gary Estremsky
(74) *Attorney, Agent, or Firm*—Douglas S. Bishop

(57) ABSTRACT

Disclosed is a door latch assembly having an integrated means to accommodate multiple backset dimension requirements while facilitating the backset adjustment selection to be done in an easy and convenient manner. The multiple backset latch has as primary components a housing body assembly and a latch bolt housing assembly. The latch bolt housing assembly includes a housing body channel member, a cam support plate member, a bolt retractor member, a cam lever member, a positioning spring member, and a housing body plate. The latch bolt housing assembly further includes a latch bolt head. The housing body channel has an oval aperture corresponding to accept the cam lever member. The oval aperture has multiple radii sufficient to accommodate lateral movement to provide 60 mm (2⅜ inches) and 70 mm (2¾ inches) backset.

11 Claims, 3 Drawing Sheets

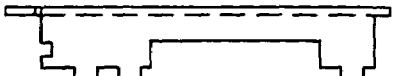
FIG. 7
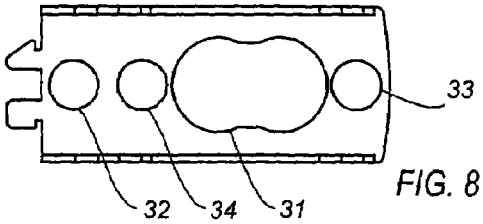
FIG. 8
FIG. 9
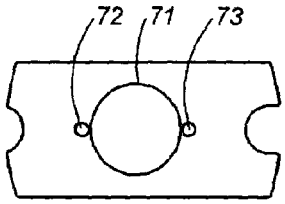
FIG.10
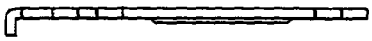
FIG. 11
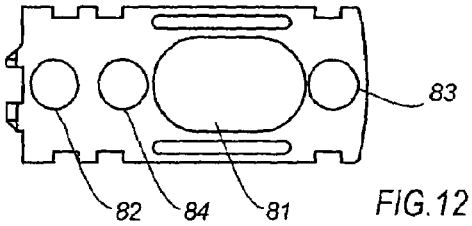
FIG.12
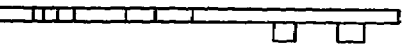
FIG. 13
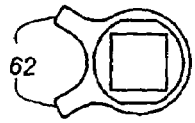
FIG. 14
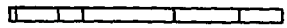
FIG. 15
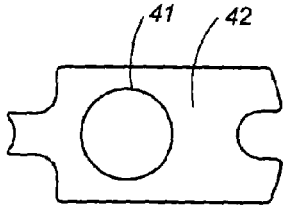
FIG. 16
FIG. 17
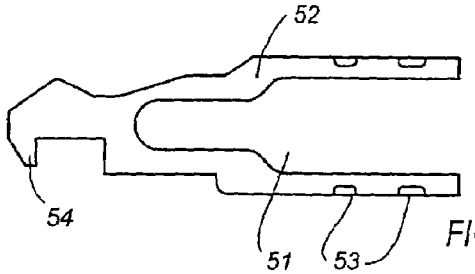
FIG. 18

MULTIPLE BACKSET LATCH

RELATED APPLICATIONS

This application claims priority under 35 USC § 120 to prior U.S. Provisional Application No. 60/580,550 to the same Applicant, filed Jun. 17, 2004, titled Multiple Backset Latch.

GOVERNMENT GRANTS/SUPPORT

None

FIELD OF THE INVENTION

The present invention relates to a latch adjustable to multiple backsets to permit one latch device to meet either 60 mm (2⅜ inches) and 70 mm (2¾ inches) backsets. The invention relates particularly to a latch mechanism design utilizing one cam instead of multiple cams.

BACKGROUND OF THE INVENTION

Industry standards in door geometry dictate lock placement and generally offer contractors two latch and knob axis-to-door-edge distances. Latch and knob axis-to-door-edge distance is described and understood within the trade as "backset". Backset is the distance from the edge of the door (wood or metal), from which the latch bolt extends, to the center of rotation of the knob. The two common backsets are 60 mm (2⅜ inches) often found in older doors and 70 mm (2¾ inches) found in more modern doors.

In the past, it was common for producers to produce separate lock and latch assemblies for each backset, and retailers would stock both types. However, both retailers who have limited shelf space, and contractors who must purchase and install latch and lock sets have demanded single latch and lock sets that can easily be adjusted to fit either backset.

A modern latch mechanism generally has a tubular latch housing mounted in a lateral bore at the edge of the door. The latching bolt has a canted forward face that provides retraction of the bolt when the face abuts against a striker plate in the doorjamb upon closing the door. The bolt springs back into the hole of the striker plate to latch the door shut. In wood doors the faceplate is conventionally rectangular in shape and fits within a mortised or chiseled recess in the door edge. The rectangular shape may have rounded corners for aesthetic purposes. In metal doors, a circular faceplate is conventionally used which has a plurality of serrations or ribs in its periphery and which is driven into and secured to the lateral bore in the door.

To date, several types of adjustable backset latches have been developed. Attempts to solve the problems associated with two common backsets have included various mechanisms to vary the backset, including latches of various lengths, multiple movable cams, linkages incorporated within the latch, fixed cam/axis devices offering two backset dimensions, moveable cams and linkages incorporated within the knob, and latch housings with multiple settings. However, many are very complex, with many parts. In addition, there is limited space available within a door, and many of the adjustable backset latch devices must have portions removed and replaced in order to change backsets, which requires disassembly of the latch mechanism in order to change backsets. Thus, there is a need for a simple, compact and efficient adjustable backset latch mechanism that can be cost-effectively manufactured, stocked, purchased, and installed with ease without disassembly of the latch mechanism in order to change backset.

SUMMARY OF THE INVENTION

The invention provides an improved door latch assembly and its installation by offering multiple backset adjustments. The present invention maintains integrity to meet American National Standards Institute (ASNI) tests and accomplish the multiple backset function by moving a single cam to either of two backset positions with the least number of components. The single rotatable lever comprised in this invention is manually moveable and easily pressed into a fixed and secured position during installation to suit the chosen backset without the need of many tools. The latch assembly of the present invention, with a singular cam lever, is radially acted upon by means of an axis and knob, of which the same mechanical means affects its incorporated pinion members and bolt retractor linkage to result in retracting a coupled latch bolt.

Most basically the invention is a multiple backset latch having as primary components a housing body assembly and a latch bolt housing assembly. The latch bolt housing assembly includes a housing body channel member, a cam support plate member, a bolt retractor member, a cam lever member, a positioning spring member, and a housing body plate. The latch bolt housing assembly further includes a latch bolt head. The housing body channel has an oval aperture corresponding to accept the cam lever member. The oval aperture has multiple radii sufficient to accommodate lateral movement to accommodate a range of 60 mm (2⅜ inches) to 70 mm (2¾ inches) backset positions.

It is a unique objective of the present invention to provide a door latch assembly having an integrated means to accommodate multiple backset dimension requirements while facilitating the backset adjustment selection to be done in an easy and convenient manner. In addition, other objectives are accomplished in a latch assembly generally installed inside a door core consisting of a latch bolt, operable and traversing longitudinally from a normal projected state beyond the door edge, and upon actuation being retracted fully into the door core. Latch retracting action is accomplished with assembly components activated by a rotatable axis displacement about a cam lever and by reversing accomplishing reciprocation of the adjacent connected latch bolt. Other objectives and aspects of the invention will become apparent by reference to the following description, drawings, and appended claims.

BRIEF DESCRIPTION OF THE DRAWINGS

The following invention can be best understood by reference to the drawings described below, and the following detailed description of the preferred embodiment.

FIG. 7 is a top view showing features of the hosing body channel.

FIG. 8 is a side view showing features of the housing body channel.

FIG. 9 is a top view showing features of the positioning spring.

FIG. 10 is a side view showing features of the positioning spring.

FIG. 11 is a top view showing features of the housing body plate.

FIG. 12 is a side view showing features of the housing body plate.

FIG. 13 is a top view showing features of the cam lever.

FIG. 14 is a side view showing features of the cam lever.

FIG. 15 is a top view showing features of the cam support plate.

FIG. 16 is a side view showing features of the cam support plate.

FIG. 17 is a top view showing features of the bolt retractor.

FIG. 18 is a side view showing features of the bolt retractor.

DETAILED DESCRIPTION OF THE INVENTION

The following is a description of the preferred embodiment of the invention. It is clear that there may be variations in the size and the shape of the mechanism, in the materials used in the construction and in the orientation of the various parts and devices of the system. However, the main features are consistent and the particular objectives, features and advantages are as disclosed herein.

Figure 1:
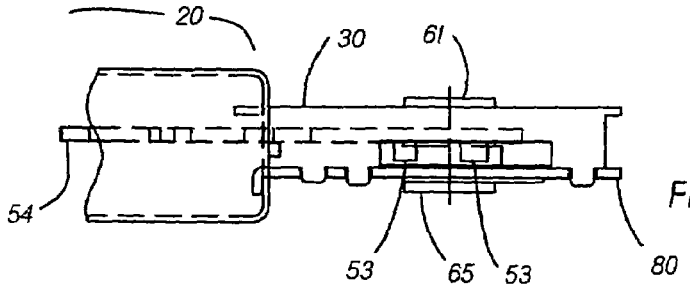
FIG. 1 is a partial top view of the door latch assembly of the present invention with integrated components to accomplish multiple backset dimension requirements and viewed as the latch bolt would be normally extended. This detailed view simply illustrates the cam lever, bolt retractor link and the embodied pinion elements.
Figure 3:
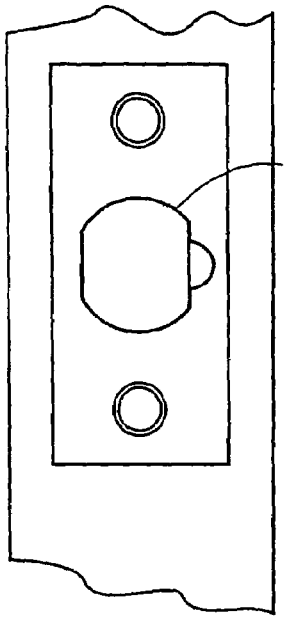
FIG. 3 is an end view of the latch bolt and latch assembly escutcheon shown as it would be installed for a right hand hinged door.
Figure 2:
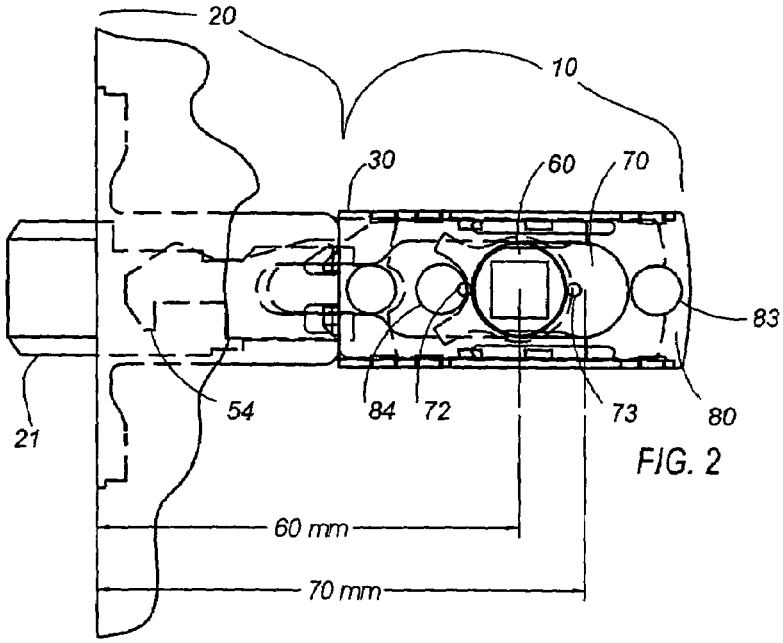
FIG. 2 is a side elevation of the latch assembly which illustrates the assembly housing geometry further revealing all member features as they effect the necessary multiple backset options.

Referring now to the Figures, in FIG. 2, a preferred embodiment of the multiple backset mechanism of the invention is illustrated. The preferred embodiment comprises integrated components of a housing body assembly 10 and a latch bolt housing assembly 20 consisting of a latch bolt head 21 of a type typically known in the Art. For simplicity, further description of latch bolt heads is not included nor required for one of ordinary skill in the art to understand the invention.

Figure 4:
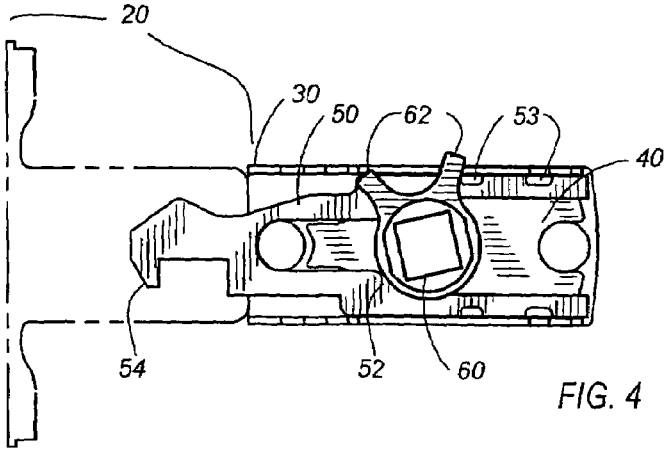
FIG. 4 is a side elevation of the latch assembly revealing the scheme of the device with the bolt retractor link in a compressed position and embodied cam lever member being typical for a latch assembly installed for a 60 mm backset requirement.
Figure 5:
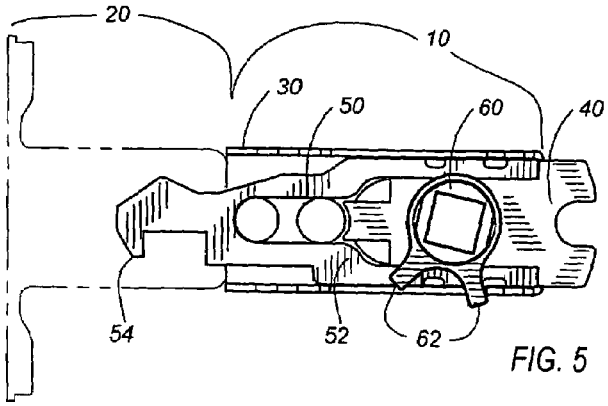
FIG. 5 is a side elevation of the latch assembly revealing the scheme of the device with the bolt retractor link in a compressed position and embodied cam lever member being typical for a latch installed for a 70 mm backset requirement.

The housing body assembly device 10 in this preferred invention is comprised of a housing body channel member 30, a cam support plate member 40 as viewed in FIG. 4, a bolt retractor member 50, a cam lever member 60, a positioning spring member 70, and a housing body plate 80.

As shown in FIG. 2, the housing body channel member 30, and also in greater deal in FIG. 8, includes an oval aperture feature 31 sized and shaped appropriately to rotatably accept the bossed end 61 of the cam lever member 60, shown in detail in FIG. 13. Oval aperture feature 31 has, embodied in its elongation, multiple radii permitting the cam lever member 60 to move laterally as it is required for assembly offering cam lever 60 axis differences to accommodate 60 mm (2⅜ inches) or 70 mm (2¾ inches) door backset. As shown in FIG. 8, the housing channel body 30 has necessary multiple apertures 32 and 33 which are paired to clear fastening devices embodied in a latch-knob assembly for a 60 mm door backset dimension. Additionally, as shown in FIG. 8, the housing body channel member 30 has an additional necessary aperture 34 located between apertures 32 and 33 which is intended to clear fastening devices embodied in a latch-knob assembly for a 70 mm door backset dimension.

As shown in FIG. 4, the cam support plate member 40, and also in greater detail in FIG. 16, includes an aperture feature 41 appropriate to rotatably accept the bossed end 61 of the cam lever member 60. Additionally, the height and thickness of the cam support plate member 40 is particularly designed to traverse laterally inside the housing body channel member 30 while also supporting the inserted cam lever member 60, therefore providing the requirement for that assembly to offer cam support plate member 40 axis differences to accommodate 60 mm or 70 mm door backsets.

As shown in FIG. 4, and also in greater detail in FIG. 18, the bolt retractor member 50 has incorporated therein an elongated aperture 51 appropriate for its central aperture to rotatably accept the bossed end 61 of cam lever member 60. But, the same central aperture feature 51 diameter, shown in detail in FIG. 18, is limited to accommodate the diameter breadth of the cam lever tangs 62 shown in detail in FIG. 13, therefore causing the cam lever shoulder face 63 of the cam lever member 60 shown in detail in FIG. 13 to bear against the bolt retractor face 52 of bolt retractor member 50. Additionally, the bolt retractor member 50 shown in detail in FIG. 18 has pairs of integrated pinions 53 situated symmetrically on the top and bottom and protruding outwardly from the bolt retractor face 52 and providing an assembly mechanical function with the cam lever member 60 by means of the cam lever tangs 62 shown in detail in FIG. 14. Moreover, the paired pinions 53 centers are also located laterally as it is required for the assembly to offer cam lever 60 axis differences to accommodate 60 mm or 70 mm door backset requirements. In whichever backset positions the latch bolt assembly is situated, the cam lever member 60 will allow interaction by means of the cam lever tangs 62 and ultimate bearing on the correspondent pinion member 53 of the bolt retractor 50 while accomplishing the same effect on the bolt retractor 50 reciprocation regardless of the rotational direction on the door latch-knob axis.

Additionally, the bolt retractor member 50 functions during the door latch-knob mechanical axis operation to retract the necessary latch bolt head 21 contained in the latch bolt housing 20 as shown in FIG. 4 by means of a pawl 54 being contained in the housing body assembly 10 adjacent to the latch bolt housing 20 and being part of the bolt retractor member 50.

Figure 6:
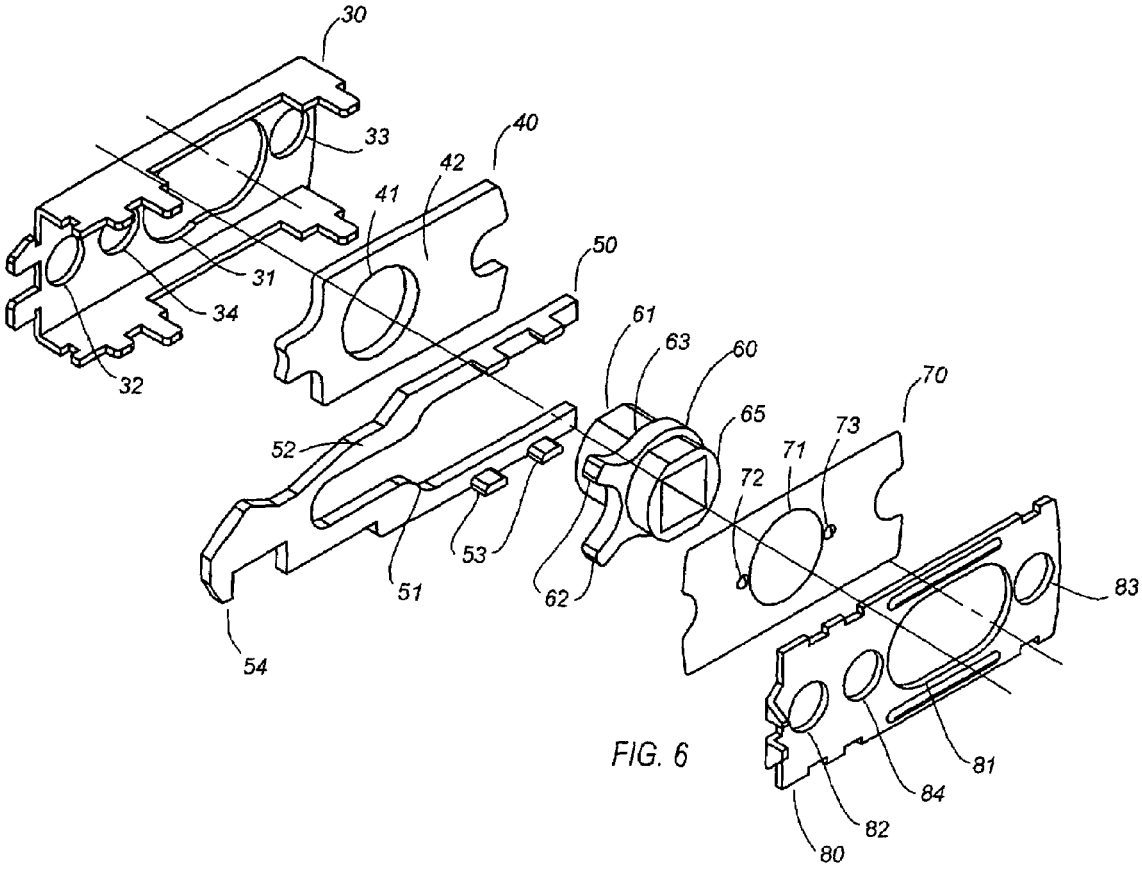
FIG. 6 is an exploded isometric view illustrating the assembly components of the preferred door latch embodiment.

As shown in FIG. 6, with reference to FIG. 10, a positioning spring member 70, being a traversing device particularly intended to secure the assembly, consisting of the cam support plate member 40 with the cam lever member 60. The positioning spring member 70, shown in greater detail in FIG. 10, includes an aperture feature 71 appropriate to rotatably accept the bossed end 65 of the cam lever member 60 as it is required for the assembly to offer cam lever 60 axis differences to accommodate 60 mm or 70 mm door backset.

Furthermore, as shown in FIG. 6, with reference to FIG. 10, the positioning spring member 70 has two protruding formed dimples 72 and opposing dimple 73 on the perimeter of the aperture 71 which interact with the housing body plate member 80 recessed openings 83 and 84 as shown in detail in FIG. 12. The detent effect of the protruding feature 72 of the positioning spring member 70 with the recess 84 in the housing body plate member 80 serves to secure the housing body assembly device 10 axis difference to accommodate the 60 mm door backset. Likewise, the detent effect of the protruding feature 73 of the positioning spring member 70 with the recess 83 in the housing body plate member 80 serves to secure the housing body assembly device 10 axis difference to accommodate the 70 mm door backset.

As described above, a single latch mechanism can be made easily adjustable to either a 60 mm or a 70 mm backset. No special or complex tools are required to adjust the backset of the present invention and only a single rotatable cam device is required. In addition, no parts must be removed or installed in order to adjust the backset. The cam lever member 60, cam support plate member 40 and positioning spring member 70 are all simply laterally slidable with respect to the housing body channel member 30, the bolt retractor member 50, and the housing body plate member 80.

The multiple backset latch device of the present invention and many of the attendant advantages are understood from the foregoing description. As noted, various and several changes may be made in the form, construction and arrangement of the parts thereof without departing from the spirit and scope of the invention or sacrificing its material advantages, the forms hereinbefore described being merely exemplary embodiments.

What is claimed is:

1. A multiple backset latch comprising:

A housing body assembly and a latch bolt housing assembly;

said latch bolt housing assembly comprising a latch bolt head shiftable between extended and retracted positions;

said housing body assembly comprising:

A housing body channel member; a cam support member disposed adjacent and within said housing body channel member and which interacts with said housing body channel member;

a bolt retractor member disposed adjacent said cam support member opposite said housing body channel member;

a cam lever member disposed adjacent said bolt retractor member opposite said cam support member and having a first and a second bossed end;

a positioning spring member disposed adjacent said cam lever member opposite said bolt retractor member, wherein said positioning spring member comprises an aperture sized and shaped to rotatably accept said second bossed end of said cam lever member; said positioning spring member securing together said cam support plate member with said cam lever member, wherein said positioning spring member is slidable laterally to align with said cam support plate member and said housing body channel member for a desired backset; and a housing body plate disposed adjacent said positioning spring member opposite said cam lever member;

wherein said positioning spring member comprises two protruding and opposing dimples on the perimeter of said aperture in said positioning spring member, wherein said two protruding and opposing dimples interact with corresponding recessed openings in said housing body plate member, wherein interaction of said two protruding and opposing dimples with said corresponding recessed openings secures said housing body plate in at least one of a 60 mm and a 70 mm backset depending on which of said dimples is positioned to interact with which of said recessed openings;

wherein said housing body channel member and said housing body plate enclose said cam support plate member, said bolt retractor member, said cam lever member and said positioning spring member therebetween to form said housing body assembly.

2. The multiple backset latch of claim 1 wherein said housing body channel member comprises a generally oval shaped aperture formed therein to rotatably accept said first bossed end of said cam lever member.

3. The multiple backset latch of claim 2 wherein said generally oval shaped aperture has, along its length, multiple radii such that said cam lever member is slidable laterally within said generally oval shaped aperture to be set at and accommodate both a 60 mm and a 70 mm backset.

4. The multiple backset latch of claim 1 wherein said housing body channel comprises multiple fastening device apertures that receive fastening devices to secure said housing body assembly together and in place in a door.

5. The multiple backset latch of claim 1 wherein said cam support member comprises an aperture sized and shaped to rotatably accept said first bossed end of said cam lever member.

6. The multiple backset latch of claim 5 wherein said cam support member is sized and shaped to fit and traverse laterally inside said housing body channel member while supporting said inserted cam lever member, thus enabling positioning of said cam support member for multiple backsets.

7. The multiple backset latch of claim 1 wherein said bolt retractor member comprises an elongated aperture sized and shaped to rotatably accept said first bossed end of said cam lever member, and wherein said elongated aperture is also sized to accommodate and engage tangs disposed on said cam lever member.

8. The multiple backset latch of claim 1 wherein said bolt retractor member comprises a bolt retractor face against which a cam lever shoulder surface bears to limit lateral motion of said cam lever member in the direction of said bolt retractor face.

9. The multiple backset latch of claim 7 wherein said bolt retractor member comprises pairs of pinions protruding out from said bolt retractor face and disposed symmetrically on the top and the bottom thereof, said pinions engagable with said tangs of said cam lever member; wherein a different pair of said pinions is engaged for each different lateral location of said cam lever member within said housing body assembly for each backset; and wherein due to the pairing and location of said pinions, reciprocation of said latch bolt head is accomplished regardless of the rotational direction of said cam lever member and door latch-knob axis.

10. The multiple backset latch of claim 1 wherein said bolt retractor member comprises a pawl disposed at one end thereof and engagable with said latch bolt head for extension and retraction of said latch bolt head.

11. A housing body assembly and a latch bolt housing assembly;

said latch bolt housing assembly comprising a latch bolt head shiftable between extended and retracted positions;

said housing body assembly comprising:

A housing body channel member; a cam support member disposed adjacent and within said housing body channel member and which interacts with said housing body channel member;

a bolt retractor member disposed adjacent said cam support member opposite said housing body channel member, said bolt retractor member comprises a pawl disposed at one end thereof and engageable with said latch bolt head for extension and retraction of said latch bolt head;

a cam lever member disposed adjacent said bolt retractor member opposite said cam support member and having a first and a second bossed end;

a positioning spring member disposed adjacent said earn lever member opposite said bolt retractor member; and a housing body plate disposed adjacent said positioning spring member opposite said cam lever member;

wherein said positioning spring member comprises two protruding and opposing dimples on the perimeter of said aperture in said positioning spring member, wherein said two protruding and opposing dimples interact with corresponding recessed openings in said housing body plate member;

wherein said housing body channel member and said housing body plate enclose said cam support plate member, said bolt retractor member, said cam lever member and said positioning spring member therebetween to form said housing body assembly.

* * * * *